US010674845B2

(12) United States Patent
Chung

(10) Patent No.: US 10,674,845 B2
(45) Date of Patent: Jun. 9, 2020

(54) CERVICAL SPINE ASSISTIVE DEVICE

(71) Applicant: Kun-Yen Chung, Tainan (TW)

(72) Inventor: Kun-Yen Chung, Tainan (TW)

( * ) Notice: Subject to any disclaimer, the term of this patent is extended or adjusted under 35 U.S.C. 154(b) by 647 days.

(21) Appl. No.: 15/355,071

(22) Filed: Nov. 18, 2016

(65) Prior Publication Data

US 2018/0140117 A1 May 24, 2018

(51) Int. Cl.

| | |
|---|---|
| ***A47G 9/10*** | (2006.01) |
| ***A61H 1/02*** | (2006.01) |
| ***A61H 39/04*** | (2006.01) |
| *A47G 9/00* | (2006.01) |

(52) U.S. Cl.

CPC ..... *A47G 9/1081* (2013.01); *A61H 1/0296* (2013.01); *A61H 39/04* (2013.01); *A47G 2009/003* (2013.01); *A47G 2009/008* (2013.01); *A61H 2201/0103* (2013.01); *A61H 2201/1284* (2013.01); *A61H 2201/1609* (2013.01); *A61H 2201/1695* (2013.01)

(58) Field of Classification Search

CPC ..... A47G 9/1081; A61H 2205/04; A61H 2015/0014; A61H 2015/0042; A61H 2015/005; A61H 2015/0064; A61H 2201/0157; A61H 2201/1609; A61H 2201/1604; A61H 2201/164; A61H 1/0296; A47C 20/02; A47C 20/04; A47C 20/08; A47C 20/027; B60N 2/80; B60N 2/882

USPC ..... D6/601, 716.5; 5/944

See application file for complete search history.

(56) References Cited

U.S. PATENT DOCUMENTS

| | | | | |
|---|---|---|---|---|
| 6,305,040 | B1 * | 10/2001 | Myler | A61H 39/04 5/630 |
| 9,756,968 | B1 * | 9/2017 | Gewant | A47G 9/1081 |
| 2013/0181497 | A1 * | 7/2013 | Gurall | A47C 16/02 297/423.1 |
| 2015/0057579 | A1 * | 2/2015 | Martinez | A61H 15/02 601/19 |

* cited by examiner

*Primary Examiner* — Nicholas F Polito
*Assistant Examiner* — Amanda L Bailey
(74) *Attorney, Agent, or Firm* — Leong C. Lei

(57) ABSTRACT

The cervical spine assistive device is a supporting pad providing relaxation and rehabilitation to cervical spine. The cervical spine assistive device includes a semi-cylindrical base member having a saddle-shaped middle section conforming to the curvature of the cervical spine. A number of semi-spherical bulges are arranged on the middle section. The heights of the bulges gradually decrease from around the user's shoulder to the user's head so as to ensure contact and support from the neck to the head, achieving enhanced relaxation and rehabilitation.

7 Claims, 5 Drawing Sheets

CERVICAL SPINE ASSISTIVE DEVICE

BACKGROUND OF THE INVENTION

(a) Technical Field of the Invention

The present invention is generally related to cervical spine, and more particular to an assistive device for supporting cervical spine as a sleep aid.

(b) Description of the Prior Art

Modern people suffer many civil diseases due to bad living habits, lack of exercise, faulty postures, etc. Among them, the deformations to various bone structures are common ones, often cause significant sore and pain. To overcome the resulted discomfort, various assistive devices have been provided and many chiropractic clinics off related treatment. Among the assistive devices, those for vertebral column correction and rehabilitation are more common. However, for cervical spine (neck), it is susceptible to various injuries as not only that the head is entirely dependent on the support of the cervical spine, but also that it is a main channel for the nerve system. If plexus or muscle of the neck is twisted, compressed, and injured, discomfort arises. Even when the patient is laid down, the larger head is supported first and the cervical spine still cannot be relaxed and healed. In addition, as the cervical spine is not suitable for chiropractic treatment, an assistive device aiding the relaxation of the cervical spine would be of great value.

SUMMARY OF THE INVENTION

A major objective of the present invention is to provide a novel cervical spine assistive device. The cervical spine assistive device includes a semi-cylindrical base member having a saddle-shaped middle section conforming to the curvature of the cervical spine. A number of semi-spherical bulges are arranged on the middle section with varying degrees of heights so that improved ventilation and effective massaging effect are achieved. When the neck is rested on the cervical spine assistive device, due the support of the cervical spine assistive device and the user's self weight, the neck is naturally stretched and the neck muscle is relaxed, achieving enhanced rehabilitation and significant aid to sleep.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

Figure 1:
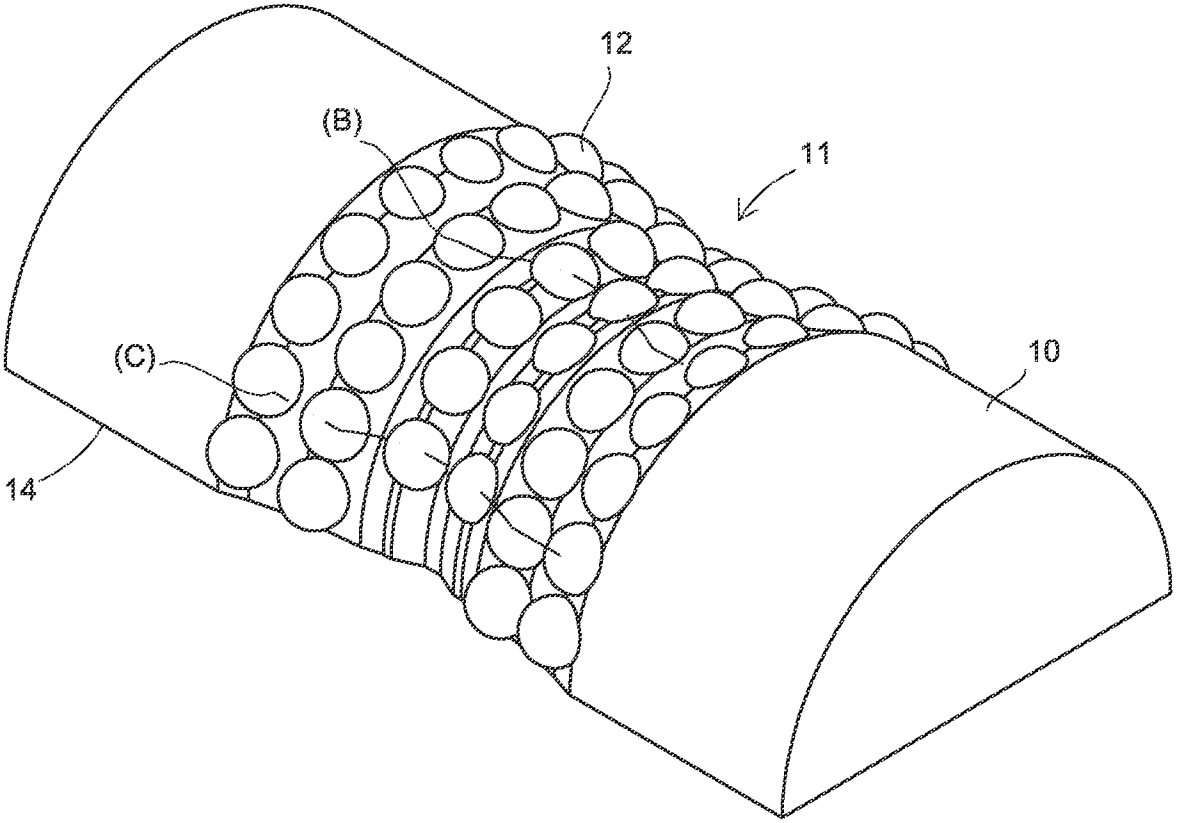
FIG. 1 is a perspective diagram showing a cervical spine assistive device according to an embodiment of the present invention.

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

As shown in FIGS. 1 to 5, a cervical spine assistive device of the present invention is a safe supporting pad to cervical spine without application of external force. As illustrated, the cervical spine assistive device includes a base member 10 having a semi-cylindrical shape. The radius for the semi-cylindrical base member 10 is between 6 and 13 cm according to user's height for better ergonomics. For a user 170 cm high, the radium is preferably 7.5 cm. The length of the semi-cylindrical base member 10 is between 30 and 50 cm so that it may be placed reliably on a surface. The base member 10 is made of a relatively hard rubber or plastic material such as Ethylene-vinyl acetate (EVA), Polyurethane (PU) with a hardness between 60 and 80 Shore hardness for better contact comfort. The base member 10 has a saddle-shaped middle section 11 for the cervical spine to rest on when a user lies down. The surface of the middle section 11 is integrally formed with a number of semi-spherical bulges 12 with narrow gaps in between. Each bulge 12 has a radium between 1.5 and 2.5 cm. The advantage of arranging bulges 12 on the saddle-shaped middle section is that they provides point contacts with cervical spine skin so that improved ventilation is achieved and the cervical spine skin does not feel sticky and sultry. The heights of the bulges 12 vary depending on their positions in the middle section 11. For bulges 12 adjacent to a first major side (C) of the base member 10 where a user's head would be lying around, their heights are ⅓ of the height of a true semi-sphere of same radius, which are the lowest ones among all bulges 12. For bulges 12 along and adjacent to the ridge (B) along the axial direction of the base member 10, their heights are ½ of the height of the true semi-sphere of same radius. For bulges 12 adjacent to a second major side (A) of the base member 10 opposite to the first major side (A) where the user's shoulder would be lying around, their heights are ⅔ of the height of a true semi-sphere of same radius, which are the highest one among all bulges 12. In other words, the heights of the bulges 12 gradually decrease from the second major side (A) to the first major side (C). When a user has his/her neck rested on the base member 10, some bulges 12 along the first and second major sides (C) and (A) press against the user's acupuncture points around the top of the neck and the shoulder. As the user breathes and turns his/her head, these bulges 12 provide massage to these acupuncture points. In addition, the support from the middle section 11 together with the mild stretching from the weight of the head achieve effective relaxation to the cervical spine without the application of external forces.

Figure 2:
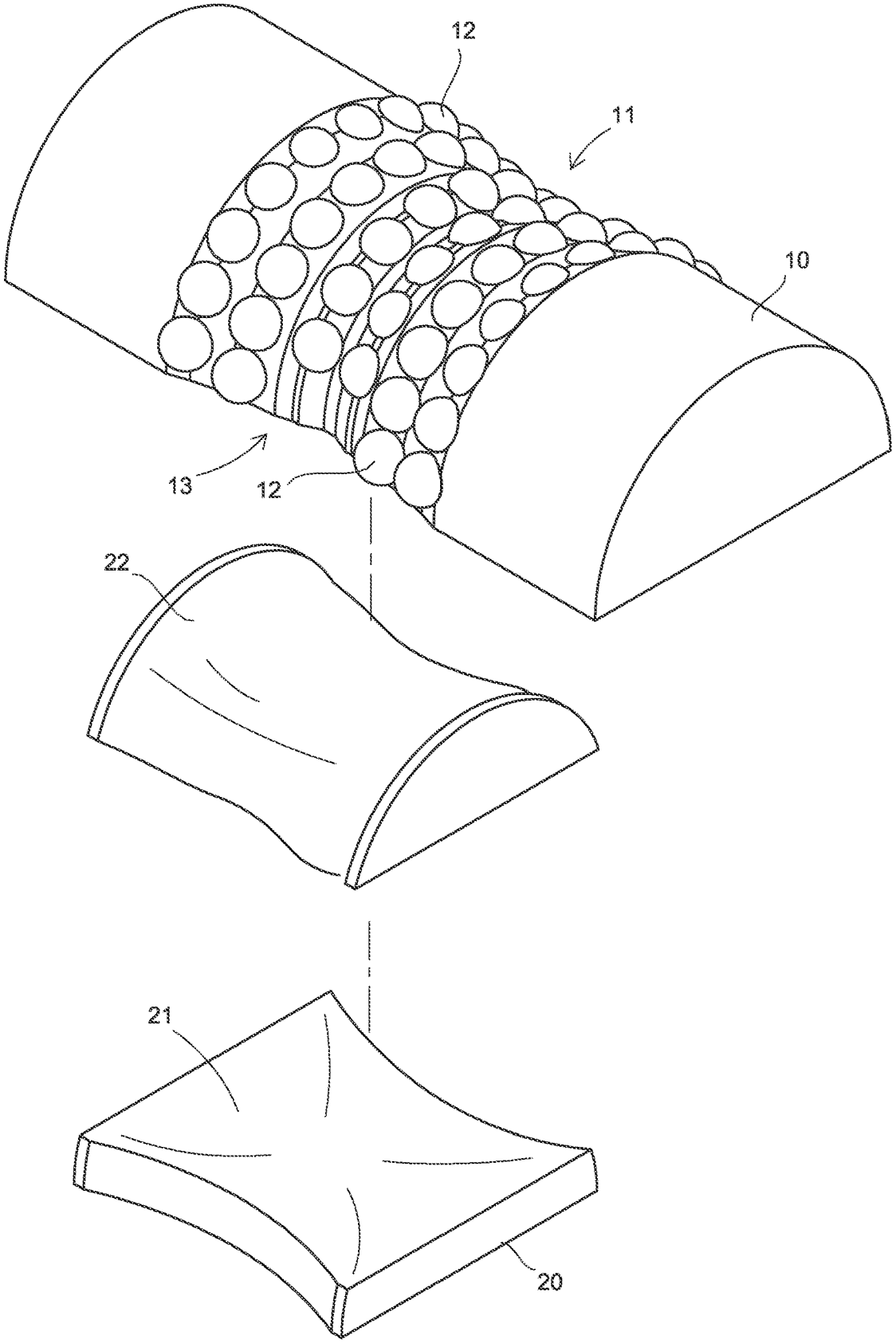
FIG. 2 is a perspective breakdown diagram showing a cervical spine assistive device according to another embodiment of the present invention.
Figure 3:
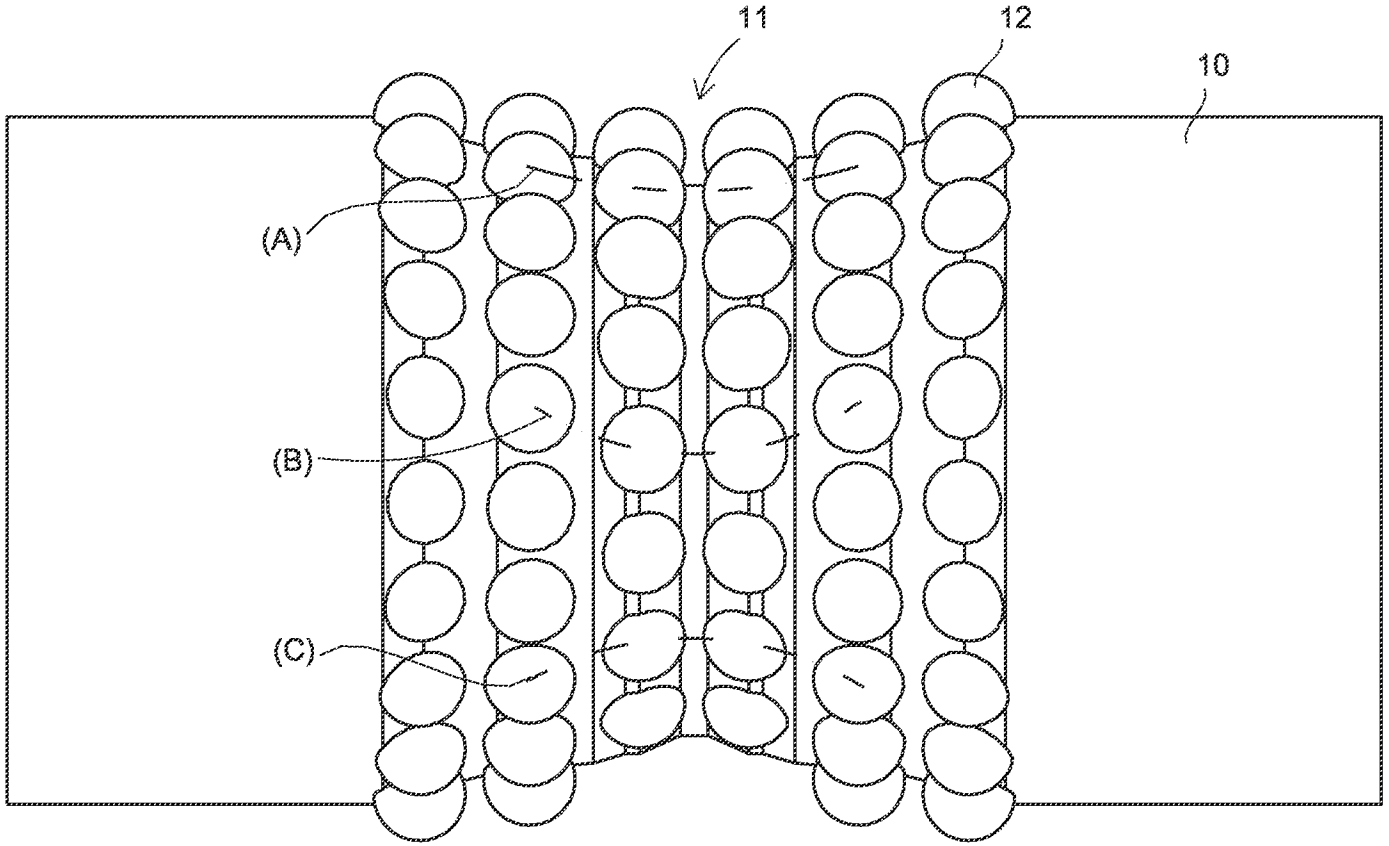
FIG. 3 is a top-view diagram showing the cervical spine assistive device of FIG. 1.
Figure 4:
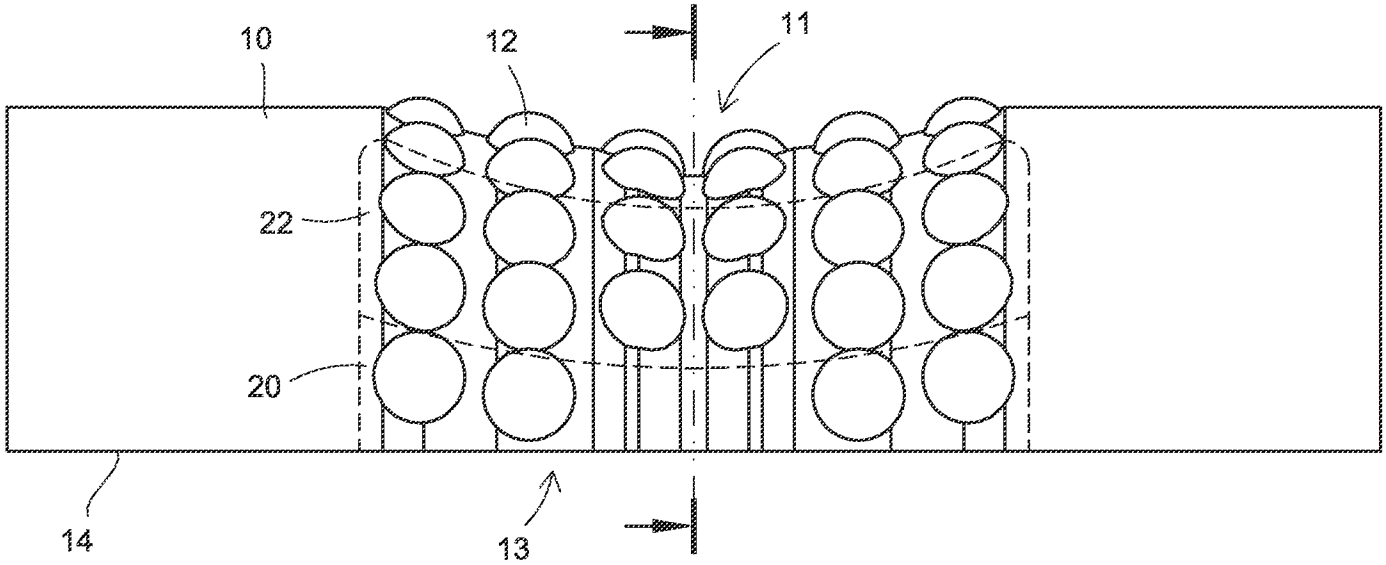
FIG. 4 is a side-view diagram showing the cervical spine assistive device of FIG. 1.

The base member 10 as described above may be integrally formed with the middle section 11 and the bulges 12. Alternatively, in order to achieve greater massaging effect, the base member 10 has a hollow space 13 inside and underneath the middle section 11 as shown in FIG. 2. As such, the support to the bulges 12 is more flexible. A flat base element 20 having a curved indentation 21 on a top side is placed in the space 13. A pad element 22 is housed in the space 13 on top of the base element 20 positioned by the indentation 21. The pad element 22 has a top side conforming to the saddle-shaped middle section 11 of the base member 10. The pad element 22 is filled with fluid or air. When the user has his/her neck rested on the base member 10, the weight of the head presses the bulges 12 and the pad element 22 below. The fluid or air within the pad element 22 is forced to the pad element 22's lateral ends, raising the bulges 12 around the lateral sides of the neck so that they are closer to the neck and thereby achieving greater comfort and relaxation effect.

Figure 5:
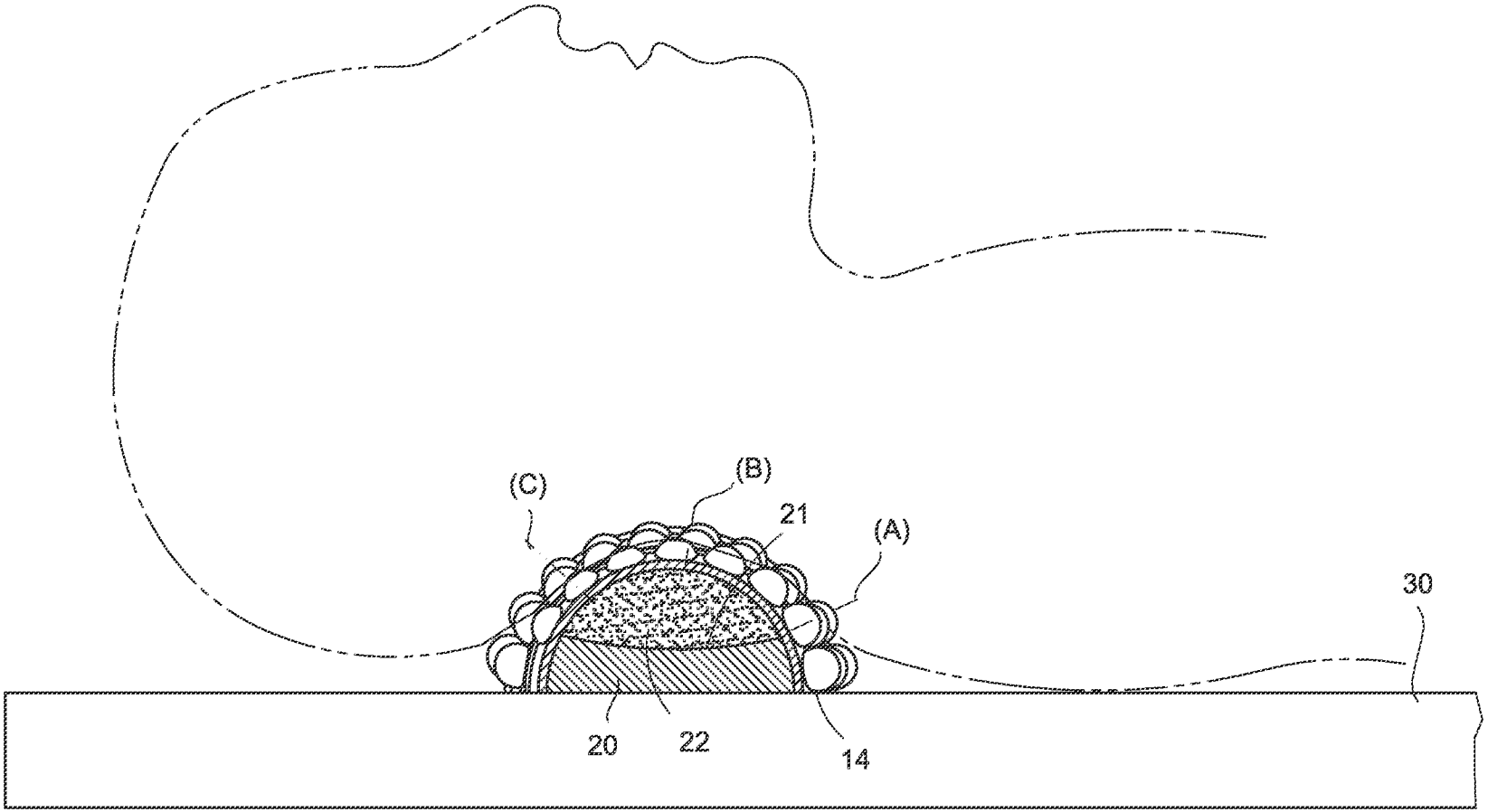
FIG. 5 is a side-view schematic diagram showing an application scenario of the cervical spine assistive device of FIG. 1.

The gist of the present invention is as follows. an appropriate and flexible material is used to form the base member 10 having a saddle-shaped middle section 11 whose surface is arranged with multiple semi-spherical bulges 12 so that their contact with a user's neck would not cause discomfort and sultry. The heights of the bulges 12 gradually decrease from around the user's shoulder to the user's head so as to achieve varying degree of massaging effect to different acupuncture points. When the cervical spine assistive device is put to use, it is positioned on a flat surface 30. To prevent the base member 10 from sliding, an anti-sliding layer 14 is configured on a bottom side of the base member 10, or the bottom side of the base member 10 is roughened. As shown in FIG. 5, the neck is rested on the middle section 11 of the base member 10. The shoulder is against the second major side of the base member 10. On the other hand, the head is slightly suspended or slightly in touch with the surface 30 so that the weight of the head naturally provides a mild stretching. The curvature of the base member 10's middle section 11 conforms to the curvature of the cervical spine so that the cervical spine is totally relaxed and effective correction or rehabilitation is achieved.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

I claim:

1. A cervical spine assistive device, comprising a semi-cylindrical base member having an inwardly curved, saddle-shaped middle section and a hollow space inside and underneath the middle section; and a plurality of semi-spherical bulges arranged in the middle section;

wherein the heights of the bulges gradually decrease from a second major side of the base member where a user's shoulder would be lying around to a first major side opposite to the second major side where the user's head would be lying around;

a fluid or air filled pad element with a length approximately as long as the middle section is housed in the space underneath the middle section and has a top side conforming to the saddle-shaped middle section of the base member, a flat base element having a curved indentation on a top side is placed in the space; and the pad element is positioned on top of the base element.

2. The cervical spine assistive device according to claim 1, wherein the radius for the semi-cylindrical base member is between 6 and 13 cm.

3. The cervical spine assistive device according to claim 1, further comprising an anti-sliding layer or a roughened surface on a bottom side of the base member.

4. The cervical spine assistive device according to claim 1, wherein, for bulges adjacent to the first major side of the base member, the heights are ⅓ of the height of a true semi-sphere of same radius; for bulges along and adjacent to a lowest ridge along the axial direction of the base member, the heights are ½ of the height of the true semi-sphere of same radius; and, for bulges adjacent to the second major side of the base member, the heights are ⅔ of the height of a true semi-sphere of same radius.

5. The cervical spine assistive device according to claim 1, wherein, when a user has his/her neck rested on the base member, the bulges along the first and second major sides press against the user's acupuncture points around the top of the neck and the shoulder.

6. The cervical spine assistive device according to claim 5, wherein the base member is made of a material having a hardness between 60 and 80 Shore hardness.

7. The cervical spine assistive device according to claim 1, wherein the base member is made of Ethylene-vinyl acetate (EVA) or Polyurethane (PU).

* * * * *